US008348691B2

(12) United States Patent
Wilson et al.

(10) Patent No.: US 8,348,691 B2
(45) Date of Patent: Jan. 8, 2013

(54) DIGITAL MULTIMEDIA CONNECTORS THAT SECURE TO CORRESPONDING DIGITAL MULTIMEDIA RECEPTACLES

(75) Inventors: Brian Wilson, Liberty, MO (US); Arvind Ramdas Mallya, Walnut Creek, CA (US); William E. Rollins, Fremont, CA (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 23 days.

(21) Appl. No.: 12/888,743

(22) Filed: Sep. 23, 2010

(65) Prior Publication Data

US 2011/0124216 A1 May 26, 2011

Related U.S. Application Data

(63) Continuation of application No. 12/622,690, filed on Nov. 20, 2009, now Pat. No. 7,824,206.

(51) Int. Cl.
*H01R 13/627* (2006.01)

(52) U.S. Cl. ..... 439/352

(58) Field of Classification Search ..... 439/352, 439/353, 488, 491
See application file for complete search history.

(56) References Cited

U.S. PATENT DOCUMENTS

| | | | | |
|---|---|---|---|---|
| 5,011,424 | A | 4/1991 | Simmons | |
| 5,154,629 | A | 10/1992 | Carver et al. | |
| 5,158,473 | A * | 10/1992 | Takahashi et al. | 439/353 |
| 5,197,900 | A | 3/1993 | Ellis et al. | |
| 5,277,627 | A * | 1/1994 | Matsuzaki | 439/677 |
| 5,435,744 | A * | 7/1995 | Derstine et al. | 439/352 |
| 5,445,534 | A | 8/1995 | Ishizuka et al. | |
| 5,449,298 | A * | 9/1995 | Fetterolf et al. | 439/352 |
| 5,486,117 | A * | 1/1996 | Chang | 439/357 |
| 5,584,718 | A * | 12/1996 | Sukegawa | 439/352 |
| 5,702,266 | A | 12/1997 | Jones | |
| 6,146,210 | A * | 11/2000 | Cha et al. | 439/680 |
| 6,250,950 | B1 * | 6/2001 | Pallai | 439/441 |
| 6,361,363 | B1 | 3/2002 | Hwang | |
| 6,461,185 | B2 | 10/2002 | James | |
| 7,040,910 | B2 * | 5/2006 | Nagata et al. | 439/352 |
| 7,175,465 | B1 | 2/2007 | Tsai | |
| 7,214,087 | B2 | 5/2007 | Kuo | |
| 7,318,740 | B1 | 1/2008 | Henry et al. | |
| 7,404,729 | B2 * | 7/2008 | Hong | 439/353 |
| 7,445,486 | B2 * | 11/2008 | Shen et al. | 439/353 |
| 7,455,545 | B2 | 11/2008 | Chawgo et al. | |
| 7,857,652 | B2 * | 12/2010 | Amidon | 439/353 |
| 2005/0208818 | A1 * | 9/2005 | Mtchedlishvili et al. | 439/352 |

(Continued)

OTHER PUBLICATIONS

"Click Here for HDMI Cable Lengths," Best Deal Cables, <https:www.bestdealcables.com/p-64-click-here-for-hdmi-cable-lengths.aspx>, retrieved Sep. 25, 2009, 2 pages.

Drawbaugh, Ben, "The next generation of HDMI actually adds some welcomed features," <http://www.engadget.com/2009/01/06/the-next-generation-of-hdmi-actually-adds-some-welcomed-features/>, posted Jan. 6, 2009, 8 pages.

(Continued)

*Primary Examiner* — Tho D Ta
(74) *Attorney, Agent, or Firm* — Toler Law Group, PC

(57) ABSTRACT

A multimedia cable may include a grip at a first end of the multimedia cable, where the grip includes a first release. An insertable connector at the first end of the multimedia cable may include a first retainer and at least one electrical connection contact. Pushing the first release inwardly toward a central axis of the multimedia cable may cause the first retainer to move inwardly toward the central axis of the multimedia cable via a first retainer arm.

17 Claims, 3 Drawing Sheets

U.S. PATENT DOCUMENTS

| | | | | |
|---|---|---|---|---|
| 2005/0221656 | A1 | 10/2005 | Haga et al. | |
| 2006/0019543 | A1 | 1/2006 | Charna | |
| 2006/0141843 | A1 | 6/2006 | Huang et al. | |
| 2008/0248671 | A1 | 10/2008 | Chawgo et al. | |
| 2009/0017669 | A1* | 1/2009 | Wu | 439/352 |

OTHER PUBLICATIONS

"A Secrets Benchmark," Secrets of Home Theater and High Fidelity, <http:www.hometheaterhifi.com/other/cable-benchmark/hdmi-cable-benchmark.html>, retrieved Sep. 25, 2009, 6 pages.

* cited by examiner

DIGITAL MULTIMEDIA CONNECTORS THAT SECURE TO CORRESPONDING DIGITAL MULTIMEDIA RECEPTACLES

CLAIM OF PRIORITY

This application is a continuation patent application of, and claims priority from, U.S. patent application Ser. No. 12/622,690, now issued as U.S. Pat. No. 7,824,206, filed on Nov. 20, 2009 and entitled "DIGITAL MULTIMEDIA CONNECTORS THAT SECURE TO CORRESPONDING DIGITAL MULTIMEDIA RECEPTACLES," which is hereby incorporated by reference in its entirety.

FIELD OF THE DISCLOSURE

The present disclosure is generally related to digital multimedia cables that secure to corresponding digital multimedia receptacles mounted in an electronic device.

BACKGROUND

A digital multimedia cable, such as a high definition multimedia interface (HDMI) cable (HDMI and the HDMI logo are trademarks or registered trademarks of HDMI Licensing, LLC), may be used to connect two electronic devices together to allow for the transfer of video content, audio content, and other information between the electronic devices. A digital multimedia connector at an end of the digital multimedia cable may include a grip and an insertable connector. The insertable connector may be positioned in a complementary digital multimedia receptacle to establish an electrical connection. The insertable connector may tightly fit in the digital multimedia receptacle to inhibit undesired removal of the connector from the digital multimedia receptacle. In addition, the insertable connector, or the digital multimedia receptacle, may include one or more spring tabs that extend into recesses in the digital multimedia receptacle, or the connector, to form an interference fit to provide additional retention of the insertable connector in the digital multimedia receptacle. For some uses of digital multimedia cables, the weight of a wiring cord of the digital multimedia cable or external forces applied to the wiring cord, may apply force to the digital multimedia connector that acts to remove the insertable connector from the digital multimedia receptacle. The force applied to the digital multimedia connector may degrade or break the electrical connection established by the digital multimedia connector. When the digital multimedia cable is a conduit that passes media content from a media content provider to a customer device, a degraded electrical connection or a break in the electrical connection may result in a service call where a technician travels to a customer residence and reestablishes a good electrical connection between the digital multimedia cable and customer premises equipment (e.g., a set-top box device). Such service calls may result in customer dissatisfaction and adds expense for a service provider.

Figure 1:
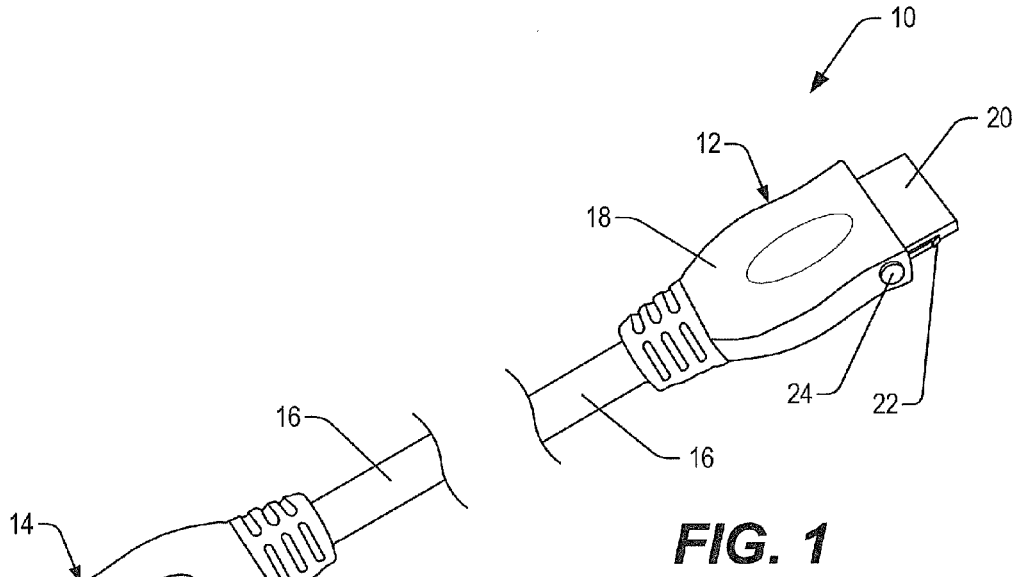
FIG. 1 is a perspective representation of a first embodiment of a digital multimedia cable.

Specific embodiments are shown by way of example in the drawings and will be described herein in detail. The drawings may not be to scale.

DETAILED DESCRIPTION

In a particular embodiment, a multimedia cable includes a grip at a first end of the multimedia cable, where the grip includes a first release. An insertable connector at the first end of the multimedia cable may include a first retainer and at least one electrical connection contact. Pushing the first release inwardly toward a central axis of the multimedia cable may cause the first retainer to move inwardly toward the central axis of the multimedia cable via a first retainer arm.

In a particular embodiment, a multimedia cable includes a grip at a first end of the multimedia cable, where the grip includes a first release. An insertable connector at the first end of the multimedia cable may include a first retainer and at least one electrical connection contact, where pushing the first release inwardly toward a central axis of the multimedia cable causes the first retainer to move outwardly away from the central axis of the multimedia cable via a first retainer arm.

In a particular embodiment, an electronic device includes a body and a high definition multimedia interface (HDMI) receptacle coupled to the body, where the HDMI receptacle is configured to receive an insertable connector.

FIG. 1 depicts a perspective representation of a first embodiment of a digital multimedia cable 10. The digital multimedia cable 10 may include a first digital multimedia connector 12, a second digital multimedia connector 14, and a wiring cord 16 connecting the first digital multimedia connector 12 to the second digital multimedia connector 14. The digital multimedia connectors 12, 14 may each include a grip 18 and an insertable connector 20. The grip 18 may facilitate placement of the insertable connector 20 in a digital multimedia receptacle of an electronic device. The insertable connector 20 may be sized and shaped to provide a tight fit in the digital multimedia receptacle of the electronic device.

The first digital multimedia connector 12 may include a retainer 22 and a release 24. The first digital multimedia connector 12 may include retainers 22 and releases 24 on each side of the first digital multimedia connector 12. The retainers 22 may be external to the insertable connector 20 with no portion of the retainers 22 passing through the insertable connector 20. The retainer 22 and the release 24 are shown in FIG. 1 positioned on a narrow side of the grip 18.

The retainer 22 may engage a portion of the digital multimedia receptacle or a portion of the electronic device to inhibit removal of the digital multimedia cable 10 from the digital multimedia receptacle when the insertable connector 20 is positioned in the digital multimedia receptacle. The release 24 may reduce a bias force applied to the retainer 22 that serves to secure the digital multimedia connector 12 to the digital multimedia receptacle. Reducing the bias force facilitates separation of the digital multimedia connector 12 from the digital multimedia receptacle. In the embodiment depicted in FIG. 1, the release 24 is a button on a side of the grip 18 of the digital multimedia connector 12. In an embodiment, the digital multimedia connector includes releases 24 on each side of the digital multimedia connector 12. The releases 24 may be spring loaded buttons on opposite sides of the grip 18. The releases 24 allow release of the digital multimedia connector 12 from the digital multimedia receptacle when a user grasps the grip 18 and moves the spring loaded buttons towards each other.

In a particular embodiment, the retainers 22 may be adjacent and external to the insertable connector 20. The retainers 22 may be positioned adjacent to side surfaces of the insertable connector 20. The engaging surfaces of the retainers 22 may engage surfaces defined by recesses or openings in the portion of the digital multimedia receptacle that the insertable connector 20 is placed in. The release 24 may be a slide or a cam that moves the retainers 22 away from the insertable connector 20 to allow the digital multimedia connector 12 to be separated from the electronic device. Other release systems that facilitate release of the digital multimedia cable 10 from the digital multimedia receptacle may also be implemented.

In the embodiment depicted in FIG. 1, the second digital multimedia connector 14 is a standard digital multimedia connector that does not include a retainer and a release. In other embodiments, both of the digital multimedia connectors 12 and 14 of the digital multimedia cable 10 may include retainers 22 and releases 24.

The digital multimedia connector 12 may be inserted into the digital multimedia receptacle by a user. The user may grasp the grip 18 of the digital multimedia connector 12 and press the releases 24. The user may guide the insertable connector 12 into the digital multimedia receptacle. When the digital multimedia connector 12 is positioned in the digital multimedia receptacle, the user may stop pressing the releases 24. After the user has stopped pressing the releases 24, the user may test that the retainers 22 secure the digital multimedia connector 12 to the digital multimedia receptacle by applying a removal force to the grip 18. The user may reinsert the digital multimedia connector 12 into the digital multimedia receptacle when the digital multimedia connector 12 begins to separate from the digital multimedia receptacle due to the applied removal force. The user may release the grip 18 when the applied removal force does not result in the digital multimedia connector 12 separating from the digital multimedia receptacle. When a user desires to disconnect the connector 12 from the receptacle, the digital multimedia connector 12 may be removed from the digital multimedia receptacle by grasping the grip 18, pressing the releases 24, and applying a removal force to separate the digital multimedia connector 12 from the digital multimedia receptacle. Thus, the digital multimedia connector 12 may be selectively secured to the receptacle or released from the receptacle.

Figure 2:
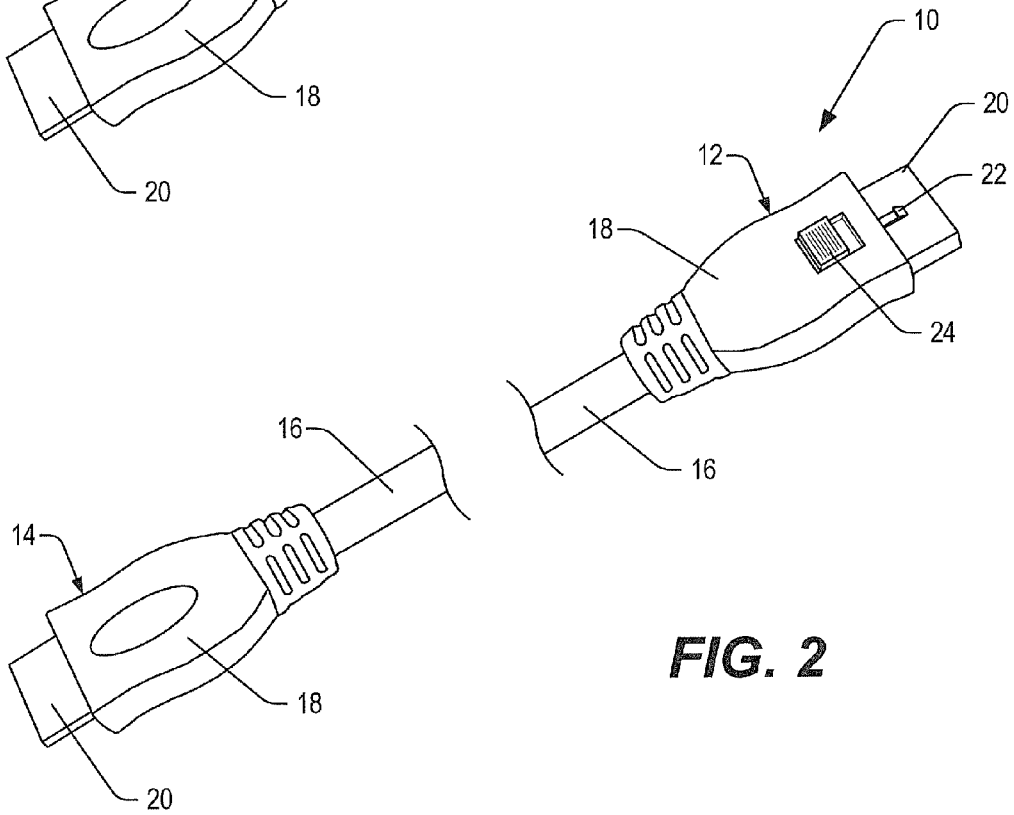
FIG. 2 is a perspective representation of a second embodiment of a digital multimedia cable.

FIG. 2 depicts a perspective representation of a second embodiment of the digital multimedia cable 10. The digital multimedia cable 10 may include a first digital multimedia connector 12, a second digital multimedia connector 14, and a wiring cord 16 connecting the first digital multimedia connector 12 to the second digital multimedia connector 14. The digital multimedia connectors 12, 14 may each include a grip 18 and an insertable connector 20. The grip 18 may facilitate placement of the insertable connector 20 in a digital multimedia receptacle of an electronic device. The insertable connector 20 may be sized and shaped to provide a tight fit in the digital multimedia receptacle of the electronic device.

The first digital multimedia connector 12 may include a retainer 22 and a release 24. The retainer 22 is shown adjacent to a top surface of the insertable connector 20. The release 24 is shown in a top surface of the grip 18. A second retainer 22 may be located adjacent to a bottom surface of the insertable connector 20. A second release 24 may be located in a bottom surface of the grip 18. The retainers 22 may be external to the insertable connector 20 with no portion of the retainers 22 passing through the insertable connector 20.

The release 24 may be a slide. Moving the release 24 may extend or retract a sleeve or cam. The sleeve or cam may apply a bias force to the retainers 22. The grip 18 may include indicia. The indicia may indicate whether the first digital multimedia connector 12 is in a locked or unlocked position. When the first digital multimedia connector 12 is in a locked position (as depicted in FIG. 2), the sleeve or cam is withdrawn to allow the retainer 22 to engage a support when the first digital multimedia connector 12 is inserted in the digital multimedia receptacle. When the retainer 22 engages the support, removal of the digital multimedia connector 12 from the digital multimedia receptacle is inhibited. A user who desires to remove the digital multimedia connector 12 from the digital multimedia receptacle may slide the release 24 to extend the sleeve or cam and press the retainers 22 against the insertable connector 20 so that interference or a bias force provided by the retainers to secure the digital multimedia connector to the digital multimedia receptacle is removed. The user may grasp the grip 18 and apply a force to remove the digital multimedia connector 12 from the digital multimedia receptacle.

Figure 3:
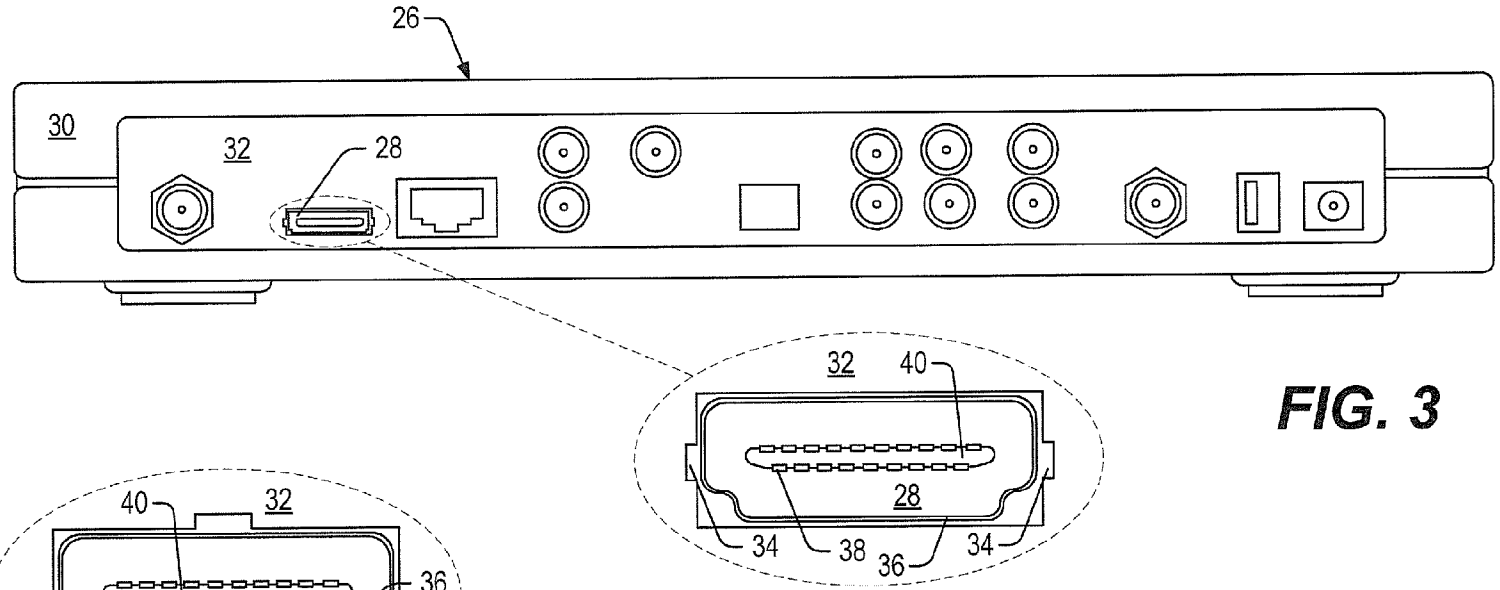
FIG. 3 is a first embodiment of a rear view of an electronic device with a digital multimedia receptacle, with an enlarged representation of the digital multimedia receptacle.

FIG. 3 depicts a first embodiment of a rear view of an electronic device 26 that includes one or more digital multimedia receptacles 28 that are able to receive a standard digital multimedia connector (e.g., the second digital multimedia connector 14 depicted in FIG. 1 and FIG. 2) or a digital multimedia connector with retainers adjacent to a narrow side of the insertable connector (e.g., the first digital multimedia connector 12 depicted in FIG. 1). The electronic device 26 may be a set-top box device. The electronic device 26 may include a body 30 and a cover 32. The body 30 may include one or more supports for printed circuit boards, electrical components, and non-electrical components of the electronic device 26. Ports for selected electrical components of the electronic device 26 may be accessed from a rear surface of the electronic device 26. Cables or other types of connectors may be coupled to the ports.

The ports may include or may be connected to the one or more digital multimedia receptacles 28. The one or more digital multimedia receptacles 28 may be coupled to the body 30 by screws, snap connects, soldering, adhesive, other connectors, or combinations thereof. The cover 32 may be positioned adjacent to the ports. The cover 32 may inhibit material from entering into the electronic device 26 adjacent to the ports. The cover 32 may include an opening having a width that is greater than a height for each digital multimedia receptacle 28. The cover 32 may include one or more passages 34 in sides of the opening corresponding to the height of the opening. The passages 34 may accommodate retainers of a digital multimedia connector (e.g., the digital multimedia connector 12 of FIG. 1) to be coupled to the digital multimedia receptacle 28.

As shown in the enlarged portion of FIG. 3, the digital multimedia receptacle 28 may include a housing 36. A plurality of electrical contacts 38 may be positioned on a mount 40 in the housing 36.

Figure 4:
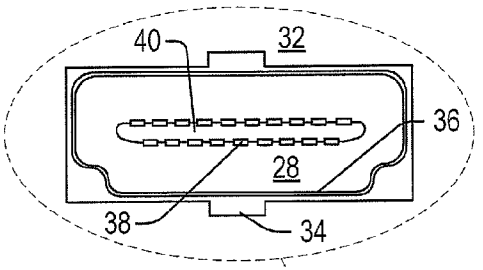
FIG. 4 is a second embodiment of a rear view of an electronic device with a digital multimedia receptacle, with an enlarged representation of the digital multimedia receptacle.
Figure 4:
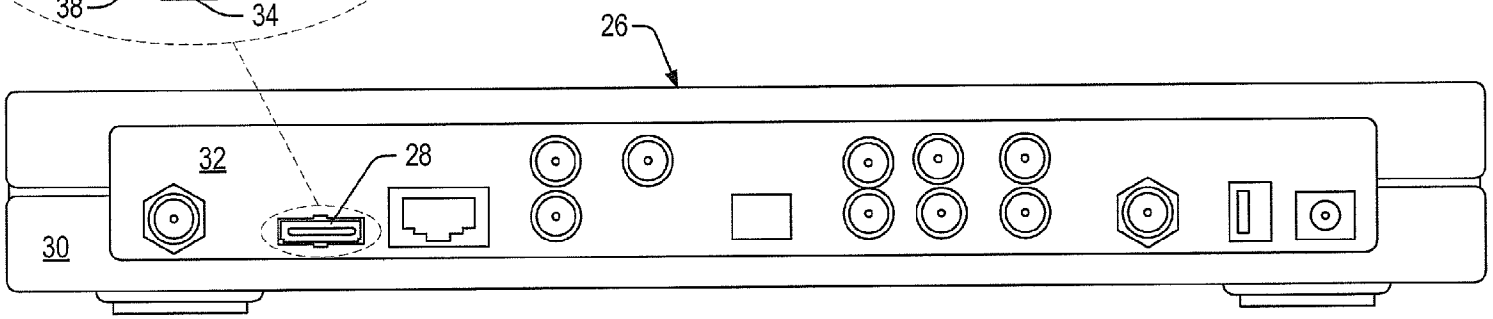

FIG. 4 depicts a second embodiment of a rear view of an electronic device 26 with one or more digital multimedia receptacles 28 that are able to receive a standard digital multimedia connector (e.g., the second digital multimedia connector 14 depicted in FIG. 1 and FIG. 2) or a digital multimedia connector with retainers adjacent to a wide side of an insertable connector of the digital multimedia connector (e.g., the first digital multimedia connector 12 depicted in FIG. 2). The cover 32 may include an opening having a width that is greater than a height for each digital multimedia receptacle 28. The cover 32 of the electronic device 26 may include one or more passages 34 in sides of the opening corresponding to the width of the opening. The passages 34 may accommodate retainers of a digital multimedia connector to be coupled to the digital multimedia receptacle 28.

As shown in the enlarged portion of FIG. 4, the digital multimedia receptacle 28 may include a housing 36. A plurality of electrical contacts 38 may be positioned on a mount 40 in the housing 36.

Figure 5:
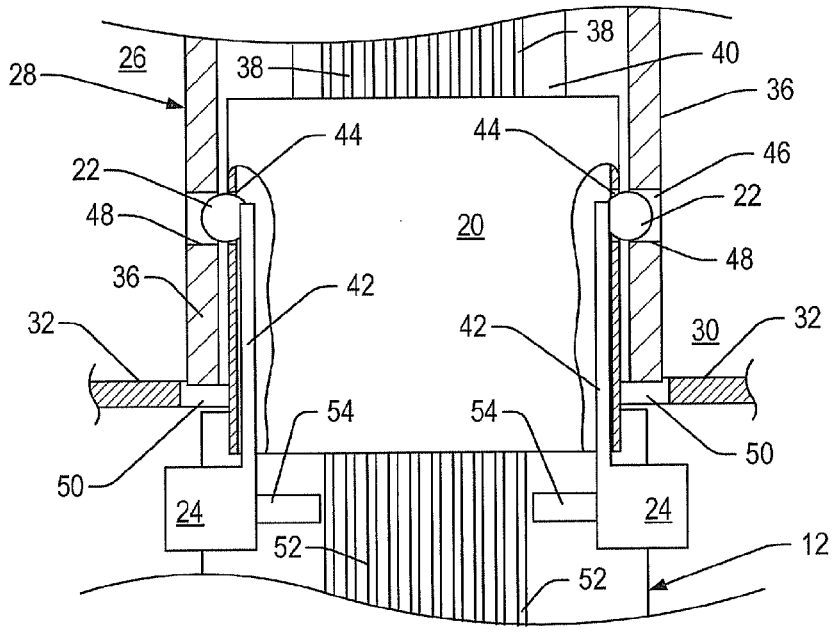
FIG. 5 is a first embodiment of a schematic representation of a portion of a digital multimedia connector coupled to a portion of a digital multimedia receptacle.

FIG. 5 depicts a first embodiment of a schematic representation of a portion of a digital multimedia connector 12 coupled to a portion of a digital multimedia receptacle 28. The digital multimedia receptacle 28 may be secured to the body 30 of the electronic device 26. Sections of insertable connector 20 of the digital multimedia connector 12 are represented in cut-out and cross section to show the position of retainer arms 42 coupled to the retainers 22 in the insertable connector 20. Portions of the retainers 22 may pass through openings 44 in the insertable connector 20.

Portions of the digital multimedia receptacle 28 are represented in cross section in FIG. 5 to show openings 46 in a housing 36 of the digital multimedia receptacle 28. In some embodiments, the openings 46 may be recesses in the digital multimedia receptacle 28 that do not extend completely through the digital multimedia receptacle 28.

A portion of the cover 32 of the electronic device 26 is shown in cross section to show an opening 50 in the cover 32 in which the digital multimedia receptacle 28 is positioned. When a user inserts the insertable connector 20 into the digital multimedia receptacle 28, the user inserts the insertable connector 20 through the opening 50 and into the housing 36 of the digital multimedia receptacle 28. The retainers 22 of the digital multimedia connector 12 may be in the insertable connector 20. Positioning the retainers 22 in the insertable connector 20 may allow the opening 50 in the cover 32 to conform to the shape of the digital multimedia receptacle 28 without the need to accommodate external retainers (e.g., the retainer 22 depicted in FIG. 1 and the retainer 22 depicted in FIG. 2).

Electrical contacts 52 of the digital multimedia connector 12 may pass into the insertable connector 20. When the insertable connector 20 is positioned in the housing 36 of the digital multimedia receptacle 28, the electrical contacts 52 may touch or make contract with corresponding electrical contacts 38 of the digital multimedia receptacle 28 to electrically couple the digital multimedia connector 12 to the digital multimedia receptacle 28. The electrical contacts 38 may be mounted on a mount 40 that extends into the housing 36. The housing 36, the electrical contacts 38, and the mount 40 are also shown in FIG. 3.

The retainers 22 of the digital multimedia connector 12 may be coupled to the retainer arms 42, which are coupled to the releases 24. The releases 24 may be in contact with one or more bias members 54. The bias members 54 may be elastomers, coil springs, or other mechanisms that apply outward directed forces to the releases 24. The forces applied by the bias members 54 to the releases 24 may act through the retainer arms 42 to move the retainers 22 through the openings 44 in the insertable connector 20. When inserting the digital multimedia connector 12 into the digital multimedia receptacle 28, the user may press the releases 24 inwards to allow the retainers 22 to pass into the housing 36 of the digital multimedia receptacle 28. Once the retainers 22 are in the housing 36 of the digital multimedia receptacle 28, the user may stop pressing the releases 24. The user may insert the insertable connector 20 into the housing 36 until openings 44 in the insertable connector 20 align with the openings 46 in the housing 36. When the openings 44 are aligned with the openings 46, the forces applied by the bias members 54 to the retainers 22 position portions of the retainers 22 in the openings 46 in the housing 36. The portions of the retainers 22 positioned in the openings 46 are sufficient to form an interference fit between the portions of the retainers 22 and surfaces 48 of the housing 36 defined by the openings 46. The interference fit inhibits unintentional removal of the digital multimedia connector 12 from the digital multimedia receptacle 28. When the retainers 22 are positioned in the openings 46 in the digital multimedia receptacle 28, a force applied to the digital multimedia connector 12 to remove the digital multimedia connector 12 from the digital multimedia receptacle 28 may be resisted by the interaction of the retainers 22 with the surfaces 48 of the housing 36 defined by the openings 46. When removal of the digital multimedia connector 12 from the digital multimedia receptacle 28 is desired, the releases 24 may be pressed to withdraw the portions of the retainers 22 from the openings 46 in the digital multimedia receptacle 28 to permit the digital multimedia connector 12 to be withdrawn from the digital multimedia receptacle 28.

Figure 6:
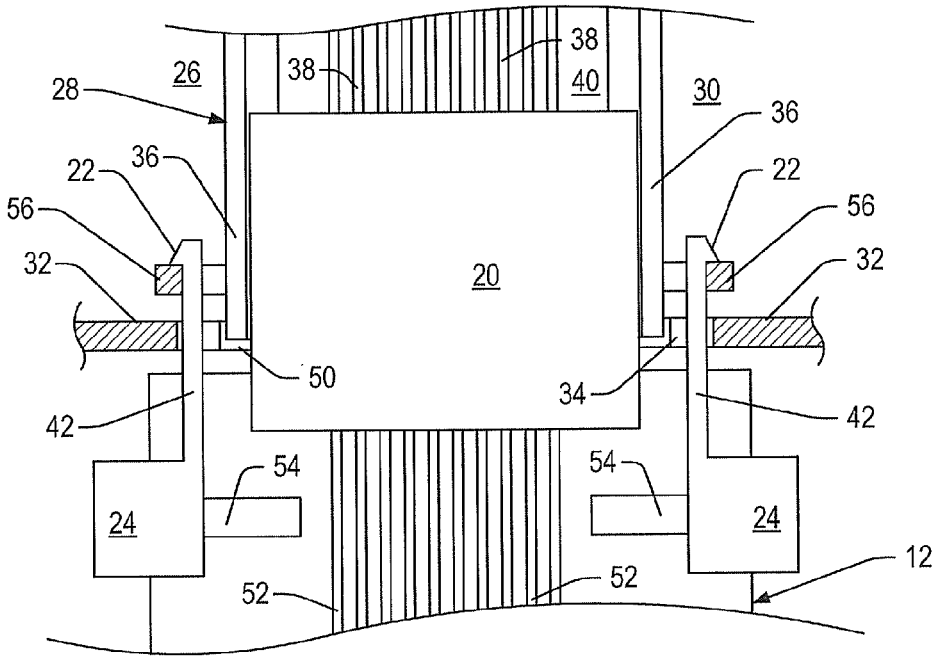
FIG. 6 is a second embodiment of a schematic representation of a portion of a digital multimedia connector coupled to a portion of a digital multimedia receptacle.

FIG. 6 depicts a second embodiment of a schematic representation of a portion of a digital multimedia connector 12 coupled to a portion of a digital multimedia receptacle 28. The digital multimedia receptacle 28 may be secured to the body 30 of the electronic device 26. The digital multimedia connector 12 includes retainers 22 that are adjacent and external to the insertable connector 20.

Electrical contacts 52 of the digital multimedia connector 12 may pass into the insertable connector 20. When the insertable connector 20 is positioned in the housing 36 of the digital multimedia receptacle 28, the electrical contacts 52 may touch or contact corresponding electrical contacts 38 of the digital multimedia receptacle 28 to electrically couple the digital multimedia connector 12 to the digital multimedia receptacle 28. The electrical contacts 38 may be placed on a mount 40 that extends into the housing 36. The housing 36, the electrical contacts 38, and the mount 40 are also shown in FIG. 4.

The retainers 22 of the digital multimedia connector 12 may be coupled to retainer arms 42, which are coupled to the releases 24. The releases 24 may be in contact with one or more bias members 54. The bias members 54 may be elastomers, coil springs, or other mechanisms that apply outward directed forces to the releases 24. The forces applied by the bias members 54 to the releases 24 may act through the retainer arms 42 to move the retainers 22 away from the insertable connector 20. When inserting the digital multimedia connector 12 into the digital multimedia receptacle 28, the user may press the releases 24 inwards to allow the retainers 22 to pass into the openings 34 in the cover 32 of the electronic device 26. The retainers 22 may include slanted surfaces to facilitate insertion of the digital multimedia connector 12 into the digital multimedia receptacle 28. When the digital multimedia connector 12 is fully inserted in the digital multimedia receptacle 28, the retainers 22 may engage supports 56. The supports 56 may be extensions from the digital multimedia receptacle 28 that are offset from the housing 36, may be mounted to the body 30 of the electronic device 26, may be portions of the cover 32, or may be a combination thereof. When the retainers 22 engage the supports 56, removal of the digital multimedia connector 12 from the digital multimedia receptacle 28 may be inhibited or at least resisted unless the releases 24 are pressed to reduce the bias force applied to the retainers 22 by the bias members 54 through the retainer arms 42.

In a particular embodiment, the retainers 22 may engage recesses or openings in the housing 36 so that the support 56 becomes part of the housing 36. The release 24 on a right side of the digital multimedia connector 12 may control the retainer 22 on the left side of the digital multimedia connector 12, and the release 24 on a left side of the digital multimedia connector 12 may control the retainer 22 on the right side of the digital multimedia connector 12. Pressing the releases may move the retainers outwards so that the engaging surfaces of the releases do not interfere with the housing and allow the digital multimedia connector 12 to be removed from the digital multimedia receptacle 28.

Retainers of a digital multimedia connector that secure a digital multimedia connector of a digital multimedia cable to a digital multimedia receptacle may be able to withstand both inadvertent forces applied to the digital multimedia connector and the weight of the digital multimedia cable to inhibit undesired separation of the digital multimedia connector from the digital multimedia receptacle. The use of the digital multimedia cable having at least one digital multimedia connector that secures to the corresponding digital multimedia receptacle may improve electrical performance of electronic devices coupled by the digital multimedia cable and may improve picture quality of video media transferred through the digital multimedia cable due to the improved electrical performance. The use of the digital multimedia cable having at least one digital multimedia connector that secures to a corresponding digital multimedia receptacle may result in fewer subscriber complaints and may obviate the need and expense of service calls to reconnect a poorly connected digital multimedia cable.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments.

The Abstract of the Disclosure is provided with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above-disclosed subject matter is to be considered illustrative, and not restrictive, and the appended claims are intended to cover all such modifications, enhancements, and other embodiments, which fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A multimedia cable comprising:

a grip at a first end of the multimedia cable, wherein the grip includes a first slide release and a second slide release;

a first retainer arm that is operatively connected to the first slide release;

a second retainer arm operatively connected to the second slide release; and an insertable connector at the first end of the multimedia cable, wherein the insertable connector includes at least one electrical connection contact;

wherein the first slide release is located at a first side of the grip, the grip having a narrow dimension and a wide dimension that is wider than the narrow dimension, wherein the first side is on the wide dimension;

wherein the first retainer arm is located at the first side of the grip; and wherein sliding the first slide release in a first direction causes the first retainer arm to extend and sliding the first slide release in a second direction causes the first retainer arm to retract, and wherein the first retainer arm is operative to engage a first support of a multimedia receptacle when the first retainer arm is extended; and wherein sliding the second slide release in the first direction causes the second retainer arm to extend and sliding the second slide release in the second direction causes the second retainer arm to retract, and wherein the second retainer arm is operative to engage a second support of the multimedia receptacle when the second retainer arm is extended.

2. The multimedia cable of claim 1, wherein the grip includes indicia to indicate whether the insertable connector is in a locked position.

3. The multimedia cable of claim 1, wherein the first retainer arm is operative to disengage the first support of the multimedia receptacle when the first retainer arm is retracted, wherein when the first retainer arm is engaged with the first support, removal of the insertable connector from the multimedia receptacle is inhibited, and when the first retainer arm is disengaged with the first support, removal of the insertable connector from the multimedia receptacle is permitted.

4. The multimedia cable of claim 1, wherein the second slide release is located at a second side of the grip, wherein the second side is on the wide dimension, and wherein the first side of the grip is opposite the second side of the grip.

5. The multimedia cable of claim 4, wherein the first retainer arm and the second retainer arm are each external to the insertable connector.

6. The multimedia cable of claim 4, wherein the first retainer arm and the second retainer arm are each internal to the insertable connector.

7. The multimedia cable of claim 1, wherein the first slide release includes a first bias member, wherein the second slide release includes a second bias member, wherein sliding the first slide release in the first direction causes the first bias member to apply a first bias force that causes the first retainer arm to extend, wherein sliding the first slide release in the second direction causes the first retainer arm to retract, wherein sliding the second slide release in the first direction causes the second bias member to apply a second bias force that causes the second retainer arm to extend, and wherein sliding the second slide release in the second direction causes the second retainer arm to retract.

8. The multimedia cable of claim 7, wherein the first bias member and the second bias member comprise one of a sleeve and a cam.

9. A multimedia cable comprising:

a grip at a first end of the multimedia cable, wherein the grip includes a first slide release including a first bias member and a second slide release;

a first retainer arm that is operatively connected to the first slide release;

a second retainer arm operatively connected to the second slide release; and an insertable connector at the first end of the multimedia cable, wherein the insertable connector includes at least one electrical connection contact;

wherein the first slide release is located at a first side of the grip, the grip having a narrow dimension and a wide dimension that is wider than the narrow dimension, wherein the first side is on the wide dimension;

wherein the first retainer arm is located at the first side of the grip;

wherein sliding the first slide release in a first direction causes the first bias member to apply a first bias force that causes the first retainer arm to extend;

wherein sliding the first slide release in a second direction causes the first retainer arm to retract;

wherein the first retainer arm is operative to engage a first support of a multimedia receptacle when the first retainer arm is extended;

wherein sliding the second slide release in the first direction causes the second retainer arm to extend and wherein sliding the second slide release in the second direction causes the second retainer arm to retract, and wherein the second retainer arm is operative to engage with a second support of the multimedia receptacle when the second retainer arm is extended.

10. The multimedia cable of claim 9, wherein the first bias member comprises one of a sleeve and a cam.

11. The multimedia cable of claim 9, wherein removal of the insertable connector from the multimedia receptacle is inhibited when the first retainer arm is engaged with the first support and the insertable connector is aligned with one or more openings of the multimedia receptacle.

12. An electronic device comprising:

a body;

a multimedia interface receptacle coupled to the body, wherein the multimedia interface receptacle is configured to receive an insertable connector of a multimedia cable, the multimedia cable having a grip at a first end, wherein a first side of the grip includes a first slide release, wherein the grip includes a first retainer arm operatively connected to the first slide release, wherein the first slide release is located at the first side of the grip, the grip having a narrow dimension and a wide dimension that is wider than the narrow dimension, wherein the first side is on the wide dimension, and wherein the first retainer arm is located at the first side of the grip, wherein a second side of the grip includes a second slide release, the second slide release operatively connected to a second retainer arm, wherein the second side of the grip is opposite the first side of the grip;

a first support of the multimedia interface receptacle, wherein the first support is located at a first side of the multimedia interface receptacle and is configured to receive the first retainer arm;

a second support of the multimedia interface receptacle, wherein the second support is located at a second side of the multimedia interface receptacle and is configured to receive the second retainer arm, wherein the first side of the multimedia interface receptacle is opposite the second side of the multimedia interface receptacle;

wherein sliding the first slide release in a first direction causes the first retainer arm to extend and sliding the first slide release in a second direction causes the first retainer arm to retract, and wherein the first retainer arm is operative to engage the first support of the multimedia interface receptacle when the first retainer arm is extended; and wherein sliding the second slide release in the first direction causes the second retainer arm to extend and sliding the second slide release in the second direction causes the second retainer arm to retract, and wherein the second retainer arm is operative to engage the second support of the multimedia interface receptacle when the second retainer arm is extended.

13. The electronic device of claim 12, wherein the first slide release includes a first bias member and the second slide release includes a second bias member, wherein sliding the first slide release in the first direction causes the first bias member to apply a first bias force that causes the first retainer arm to extend, wherein sliding the first slide release in the second direction causes the first retainer arm to retract, wherein sliding the second slide release in the first direction causes the second bias member to apply a second bias force that causes the second retainer arm to extend, wherein sliding the second slide release in the second direction causes the second retainer arm to retract, and wherein the first bias member and the second bias member comprise one of a sleeve and a cam.

14. The electronic device of claim 12, wherein the multimedia interface receptacle includes a plurality of electrical contacts positioned on a mount, and wherein the plurality of electrical contacts is adapted to form an electrical connection with at least one electrical connection contact of the insertable connector when the insertable connector is inserted into the multimedia interface receptacle.

15. The electronic device of claim 12, wherein the first support is mounted on the body of the electronic device and wherein the body provides support for electrical components and non-electrical components.

16. The electronic device of claim 12, wherein the first support and the second support are mounted in a housing of the multimedia interface receptacle and wherein the first retainer arm engages the first support through a first recess in the housing and the second retainer arm engages the second support through a second recess in the housing.

17. The electronic device of claim 12, wherein the first support is a portion of a cover and wherein the multimedia interface receptacle is positioned within an opening of the cover.

* * * * *